US005752840A

United States Patent [19]

Wu et al.

[11] Patent Number: 5,752,840

[45] Date of Patent: May 19, 1998

[54] TERMINATOR

[75] Inventors: Kun-Tsan Wu, Tu-Chen; Peter Kuo, Chung-Ho, both of Taiwan

[73] Assignee: Hon Hai Precision Ind. Co., Ltd., Taiwan

[21] Appl. No.: 654,561

[22] Filed: May 29, 1996

[51] Int. Cl.[6] ..... H01R 9/09

[52] U.S. Cl. ..... 439/76.1; 439/485; 439/736; 439/936

[58] Field of Search ..... 439/70, 78, 83, 439/485, 487, 932, 934, 936, 604, 736, 76.1

[56] References Cited

U.S. PATENT DOCUMENTS

| | | | |
|---|---|---|---|
| 4,582,384 | 4/1986 | Frantz et al | 439/736 |
| 4,775,333 | 10/1988 | Grider et al. | 439/76.1 |
| 4,932,873 | 6/1990 | La Shier | 439/76 |
| 4,954,089 | 9/1990 | Jensen et al. | 439/76.1 |
| 5,100,347 | 3/1992 | Malasky, III et al. | 439/604 |
| 5,268,815 | 12/1993 | Cipolla et al. | 439/485 |
| 5,338,221 | 8/1994 | Bowen et al. | 439/405 |

*Primary Examiner*—J. J. Swann

[57] ABSTRACT

A terminator includes a housing with a standard dimension in either lengthwise or lateral direction for receiving a plurality of contacts therein. A PC board, which is substantially much larger than the housing in the lateral direction, is attached to the housing wherein the contacts extend through the corresponding holes in the PC board. A protective cover is positioned above the PC board for hermetically shielding the inside PC board wherein such cover can be attached to the PC board through the injection molding process, or can be fastened to the high walls which integrally extend from the housing for surrounding the PC board therein.

3 Claims, 9 Drawing Sheets

TERMINATOR

BACKGROUND OF THE INVENTION

1. Field of the Invention

The invention relates to terminators, and particularly to the terminator for use with a flat cable and having good self-retention mechanism and heat dissipation effect.

2. The Prior Art

Because the transmission speed in the computer system becomes faster and faster, it is required to have electrical components built on the PC board or in the connectors for filtering the undesired noise signals and absorbing the possible bouncing back signals to avoid interference during high frequency transmission. In general, the connector with the associated components such as the capacitors or resistors mounted on an internal PC board for absorption of undesired signals can be deemed as a terminator. In the past, most of the terminators include passive electrical components therein for the simpler filtering function, the horizontal and height dimensions of which components occupy less space and generally can be installed within the original connector contour, for example, U.S. Pat. Nos. 4,857,002, 4,932,873, 5,108,294, and 5,472,348. Recently, the active electrical components are required to be associated with the terminator for higher level performance including voltage regulation, while such active components are of substantially a larger dimension. Therefore, an expanded larger dimensional structure of the terminator is desired, which should not only have a good retention between the internal PC board and the connector contacts, and a good self-securement of the terminator among its own individual parts, but also have a good heat dissipation effect for efficiently removing the heat, generated by the active components, from the terminator.

SUMMARY OF THE INVENTION

According to an aspect of the invention, a terminator includes a housing with a standard dimension in either lengthwise or lateral direction for receiving a plurality of contacts therein. A PC board, which is substantially much larger than the housing in the lateral direction, is attached to the housing wherein the contacts extend through the corresponding holes in the PC board. A protective cover is positioned above the PC board for hermetically shielding the inside PC board wherein such cover can be attached to the PC board through the injection molding process, or can be fastened to the high walls which integrally extend from the housing for surrounding the PC board therein.

DETAILED DESCRIPTION OF THE PREFERRED EMBODIMENT

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1A:
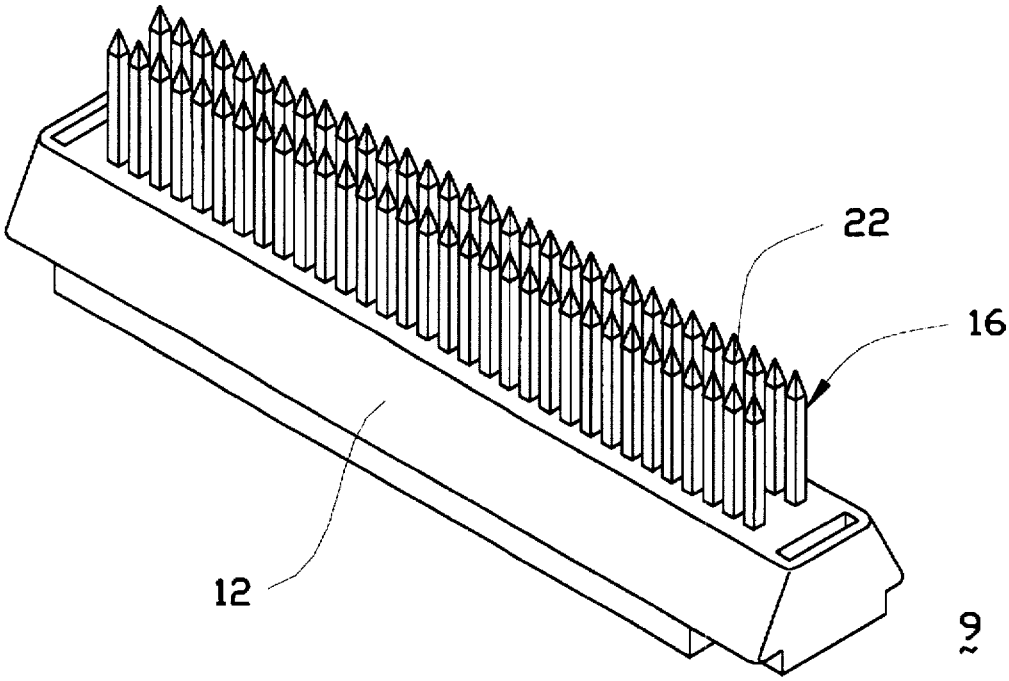
FIG. 1(A) is a perspective view of a subassembly, including the housing, the contacts and the spacer, of a terminator according to the invention.
Figure 1C:
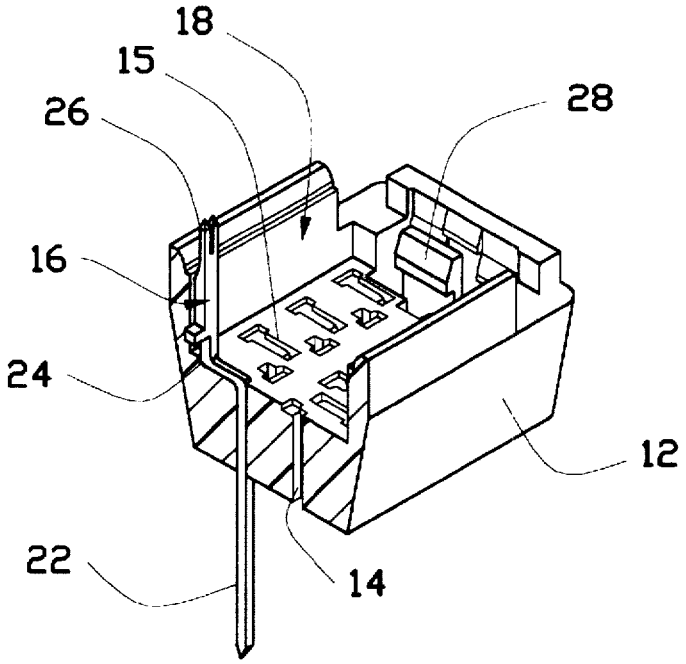
FIG. 1(C) is a fragmentary perspective view of the upside-down housing with contacts therein in to show the underside structure of the housing and how contacts are retained with regard to the housing.
Figure 1B:
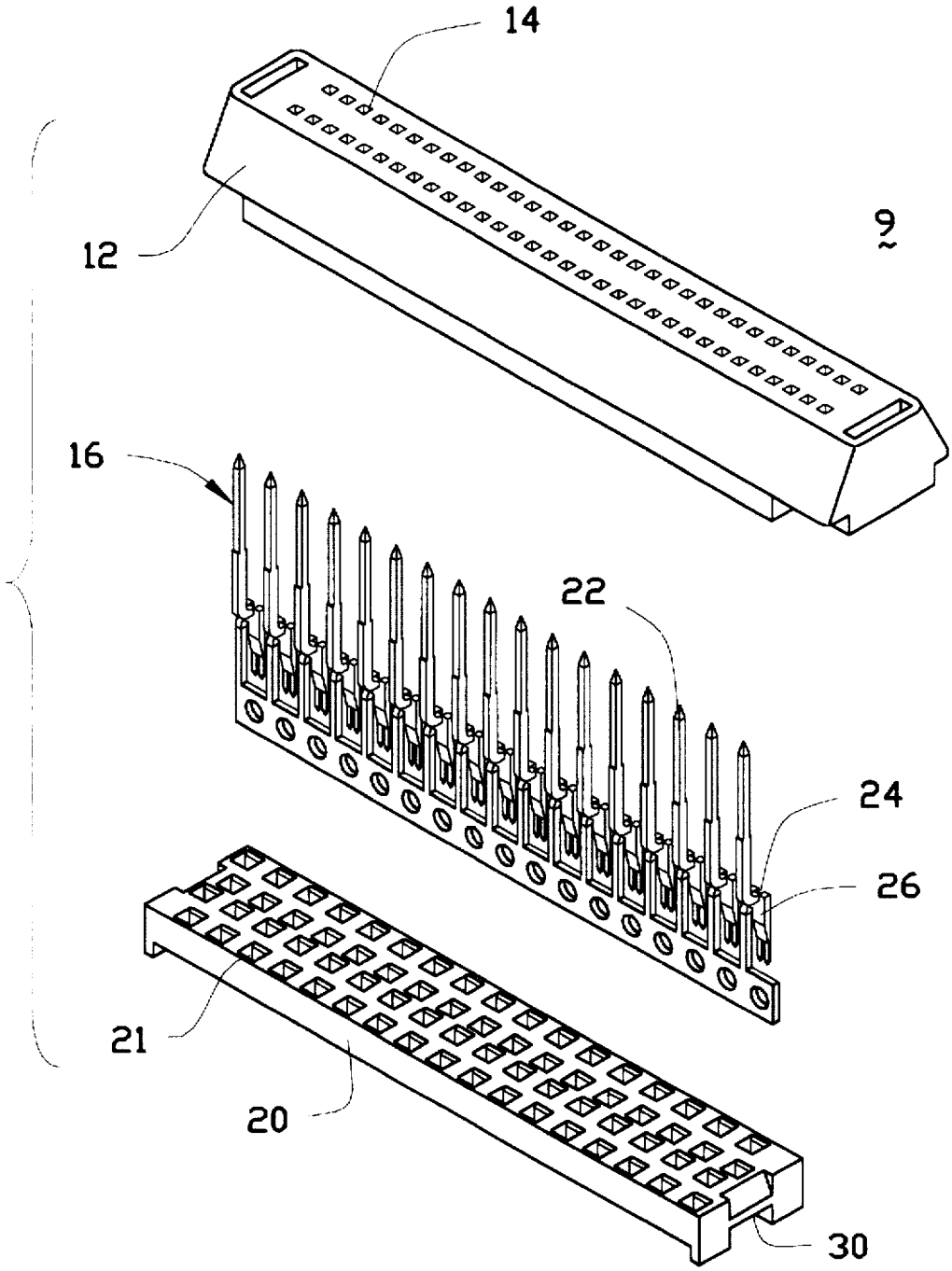
FIG. 1(B) is an exploded view of the subassembly of the terminator of FIG. 1(A) wherein the associated carrier of contacts, which is only used for loading the contacts into the housing of the terminator, has not been removed therefrom but will cut off after the contacts have been completely installed to the housing.

It will be noted here that for a better understanding, most of like components are designated by like reference numerals throughout the various figures in the embodiments. Attention is directed to FIGS. 1(A)–1(C) wherein a subassembly 9 of the subject terminator 10 includes an insulative housing 12 having a plurality of passageways 14 vertically extending therethrough for receiving a plurality of contacts 16 therein. A cavity 18 is formed on the underside portion of the housing 12 (FIG. 1(C)) for receiving therein a spacer 20 wherein the spacer 20 includes a plurality of passages 21 vertically extend therethrough for aligning the corresponding contacts 16, respectively.

The contact 16 is generally of an IDC (Insulation Displacement Contact) type including a vertical pin 22, a horizontal retention section 24, and a vertical fork 26 whereby the pin 22 can be received within the corresponding passageway 14 in the housing 12, the retention section 24 can be received within a slot 15 (FIG. 1(C)) associated with the corresponding passageway 14, and the fork 26 extends through the corresponding passage 21 in the spacer 20 wherein the tip of the fork 26 is exposed to an exterior to pierce into the corresponding flat cable 68 (FIG. 8) for conduction.

The spacer 20 can be fastened to the housing 12 by means of latches 28 of the housing, which is formed on the underside portion of the housing 12, with engagement with the edges 30 of the spacer 20. Under this situation, the horizontal retention section 24 of the contact 16 is substantially sandwiched between the spacer 20 and the housing 12. The detailed structure of this subassembly 9 of the terminator 10 can be referred to the copending application of Ser. No. 08/587,025 filed on Jan. 16, 1996.

Figure 2:
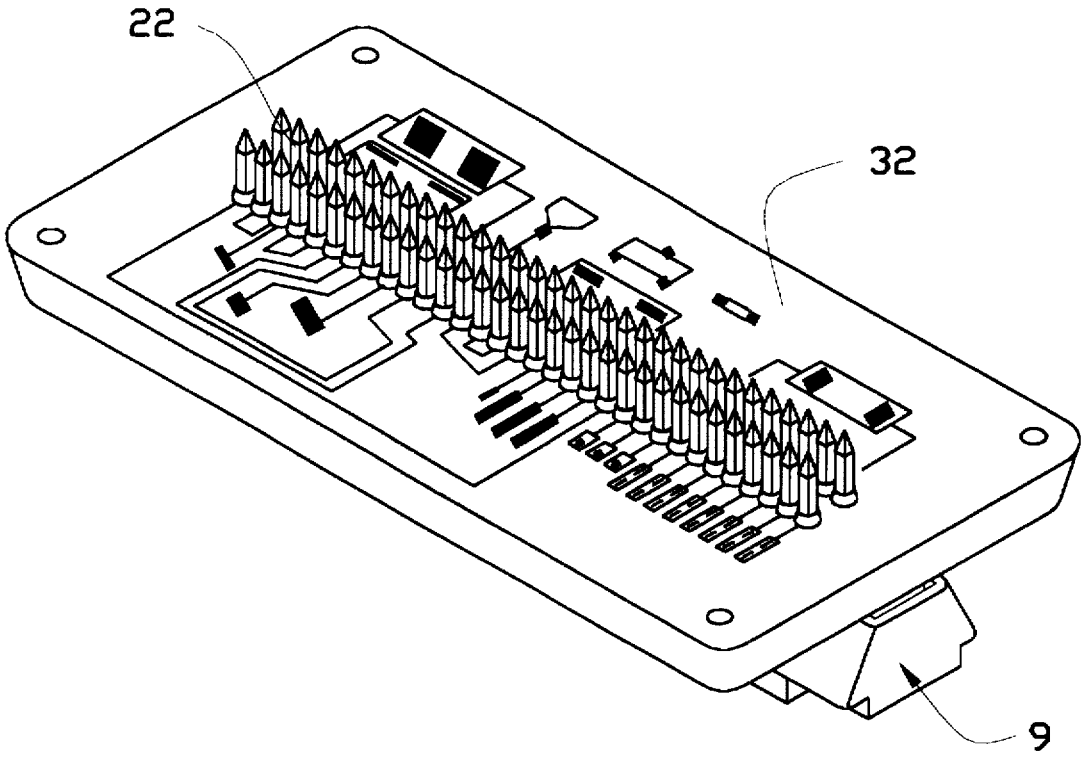
FIG. 2 is a perspective view of the PC board and the subassembly of the terminator of FIG. 1 to show the securement therebetween.

Referring to FIG. 2, after the subassembly 9 has been assembled, an wider PC board 32, which has substantially a larger dimension than the housing 12 in the lateral direction and has many electrical components including active ones and passive ones mounted thereon, is attached to the top of the housing 12 wherein the pins 22 of the contacts 16 extend through the corresponding holes for wave soldering, thus fixing the PC board 32 with regard to the housing 12.

Figure 3A:
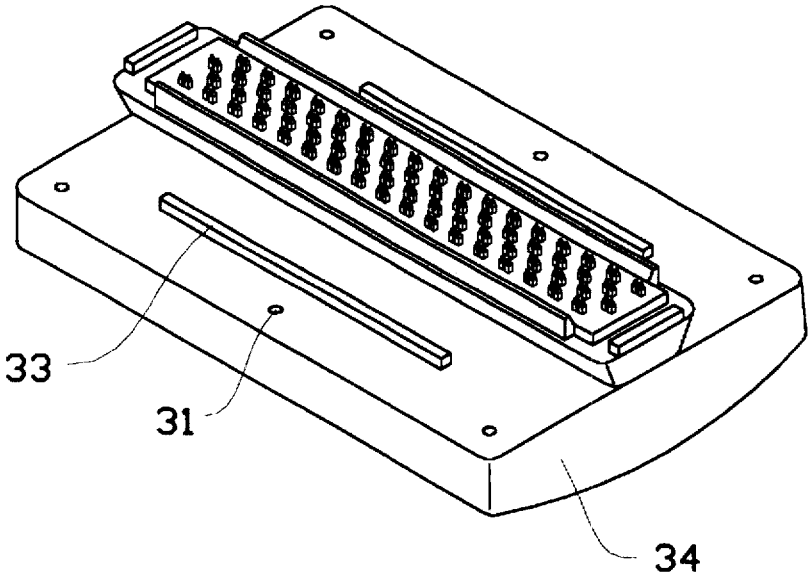
FIG. 3(A) is a perspective view of the upside-down assembled PC board and subassembly of FIG. 1 with an inner coating layer thereon.
Figure 3B:
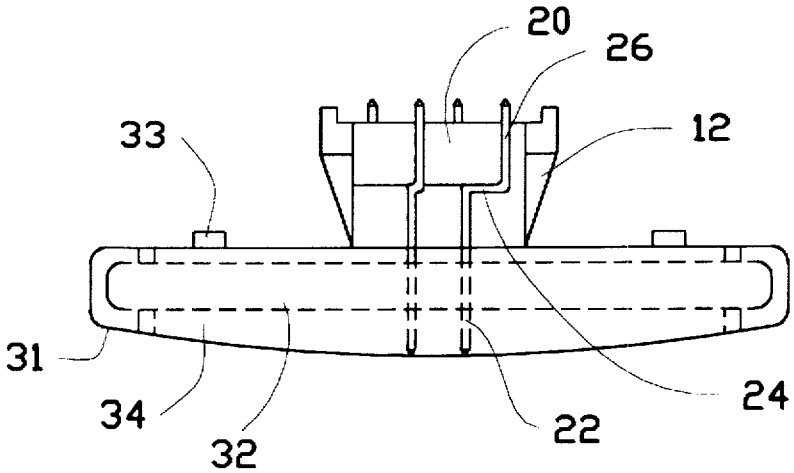
FIG. 3(B) is a side view of the upside-down assembled PC board and subassembly of FIG. 1 with an inner coating layer thereon.

Referring to FIGS. 3(A) and 3(B), after the PC board 32 has been securely attached to the housing 12, an insulative inner coating layer 34 is applied unto and surrounding the PC board 32 wherein the inner coating layer 34 is of an epoxy having characters of heat-proof and viscosity so that during the molding procedure, this liquid type material does not result in too large impact to jeopardize the components on the PC board 32. The molded inner layer 34 includes plural recesses 31 extending inward from and two ribs 33 formed on the surface.

Figure 4A:
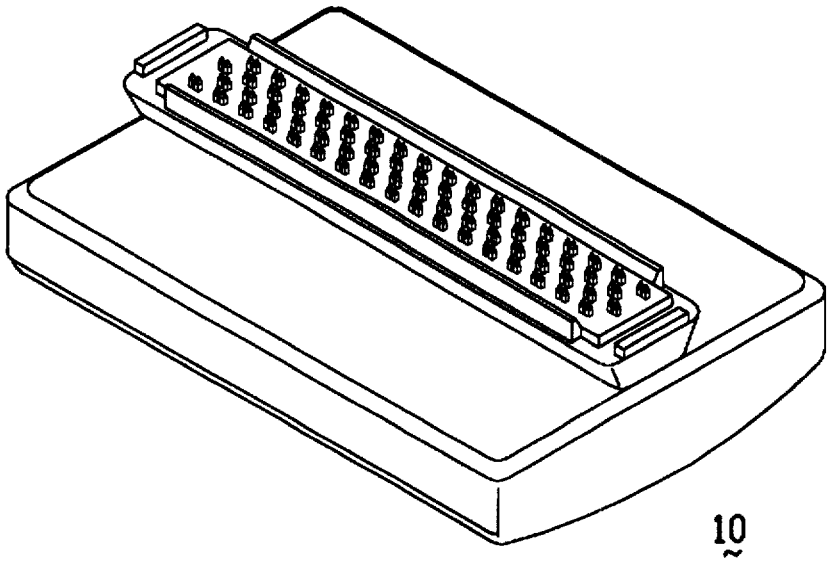
FIG. 4(A) is a perspective view of the upside-down assembled PC board and subassembly of FIG. 1 with an inner coating layer and an outer coating layer thereon.
Figure 4B:
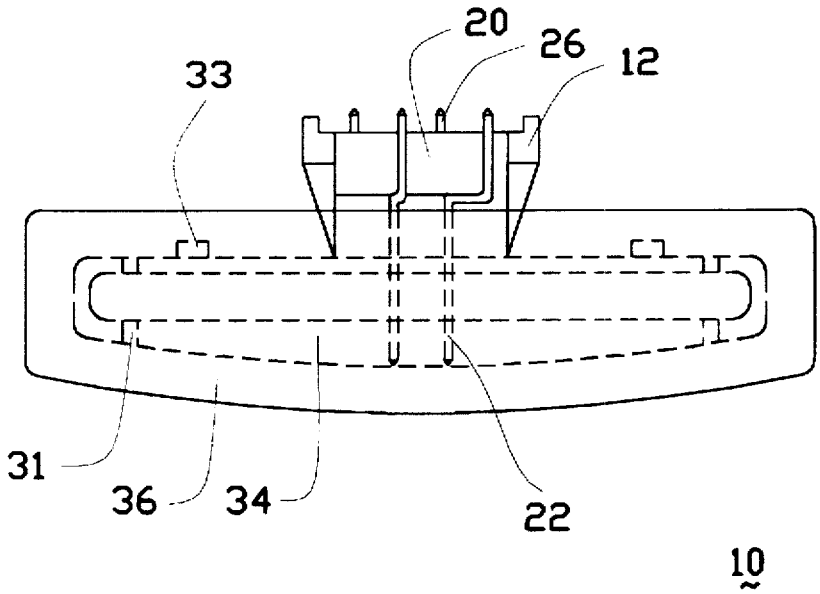
FIG. 4(B) is a side view of the upside-down assembled PC board and subassembly of FIG. 1 with an inner coating layer and an outer coating layer thereon.

Referring to FIGS. 4(A) and 4(B), successively, an outer layer 36 is applied unto and surrounding the inner layer 34 wherein the outer layer 36 is of an epoxy having characters of impact and chemical resistance, and good processing. During this molding process, the outer layer 36 may invade the recesses 31 in the inner layer 34 and also form the channels for receiving the corresponding ribs 33 of the inner layer 34, thus assuring the secure combination of the inner layer 34 and the outer layer 36. Therefore,the terminator 10 including the outer layer 36 and the inner layer 34 surrounding the PC board 32 and the housing 12, is formed as one piece.

It can be seen that this terminator 10 is intended to be used with a flat cable 68 (FIG. 8) which is adapted to be attached to the bottom of the housing 12 by means of a bottom cover 66 (FIG. 8) wherein the forks 26 of the contacts 16 pierce into the flat cable 68 for conduction.

In comparison with the prior art terminators, the large PC board 32 of this embodiment of the invention not only provides the terminator 10 with more space in a lateral direction for installing both active and passive components thereon and for better heat dissipation, but also provides reliable reinforced structure for holding the PC board 32 with the housing 12 in the terminator 10, thus assuring the whole terminator 10 can stand in severe vibration situation or circumstance.

Figure 5:
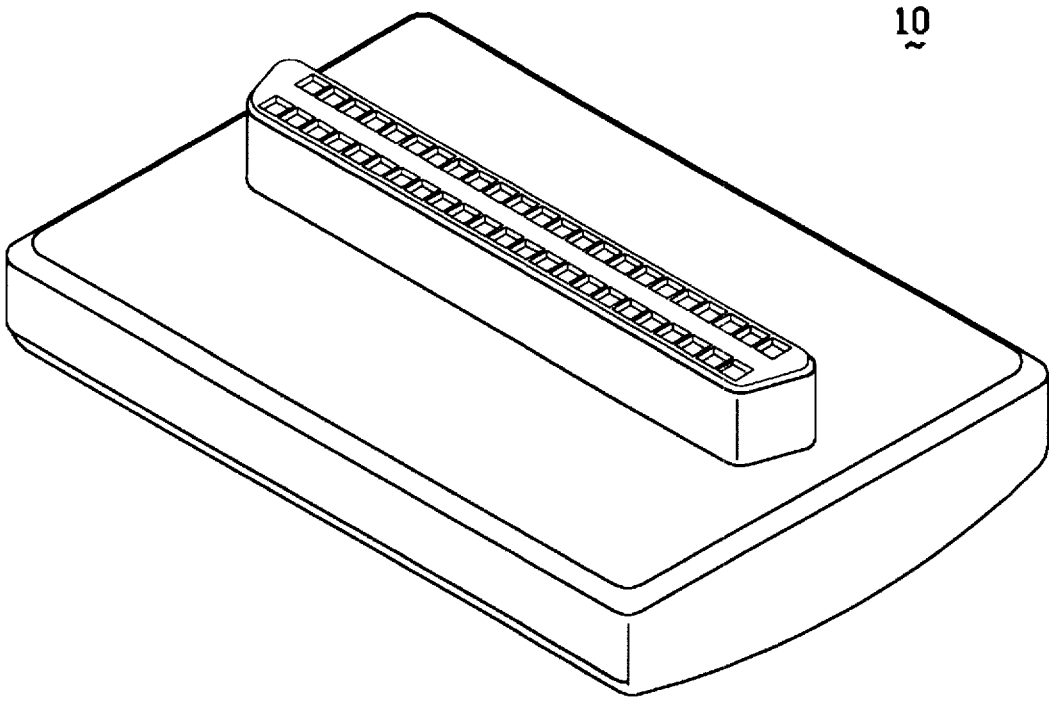
FIG. 5 is an upside-down perspective view of another type terminator having the same basic structure of the terminator of FIG. 1.

FIG. 5 shows another type terminator having the similar structure as the IDC type terminator as shown in FIG. 1 wherein the forks 26 of the contacts 16 are replaced by the socket type members for defining an I/O (Input/output) port thereon for use with a backpanel I/O connector of the computer.

Figure 6:
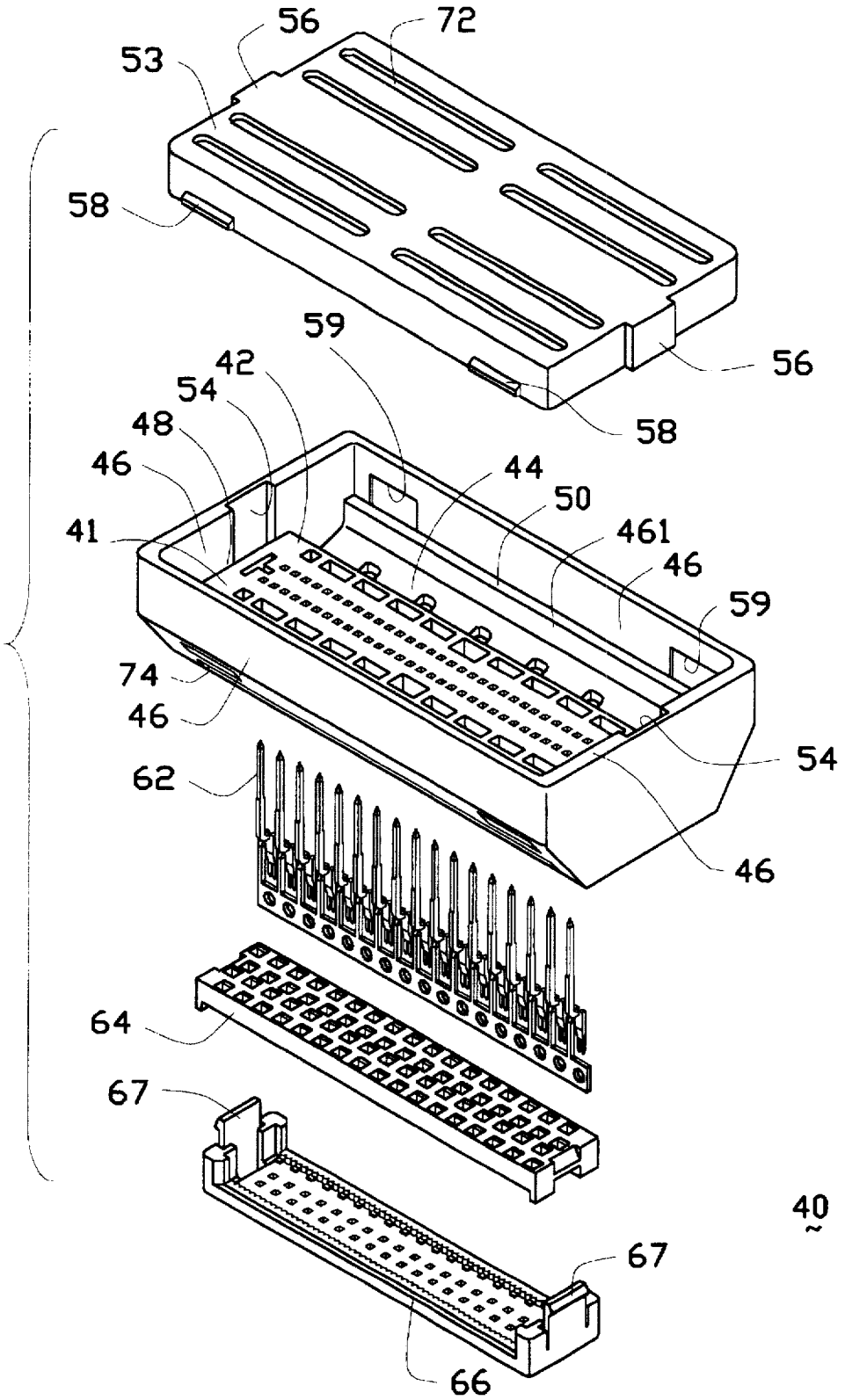
FIG. 6 is an exploded perspective view of a second embodiment of the terminator without the internal PC board shown therein, according to the invention.
Figure 7:
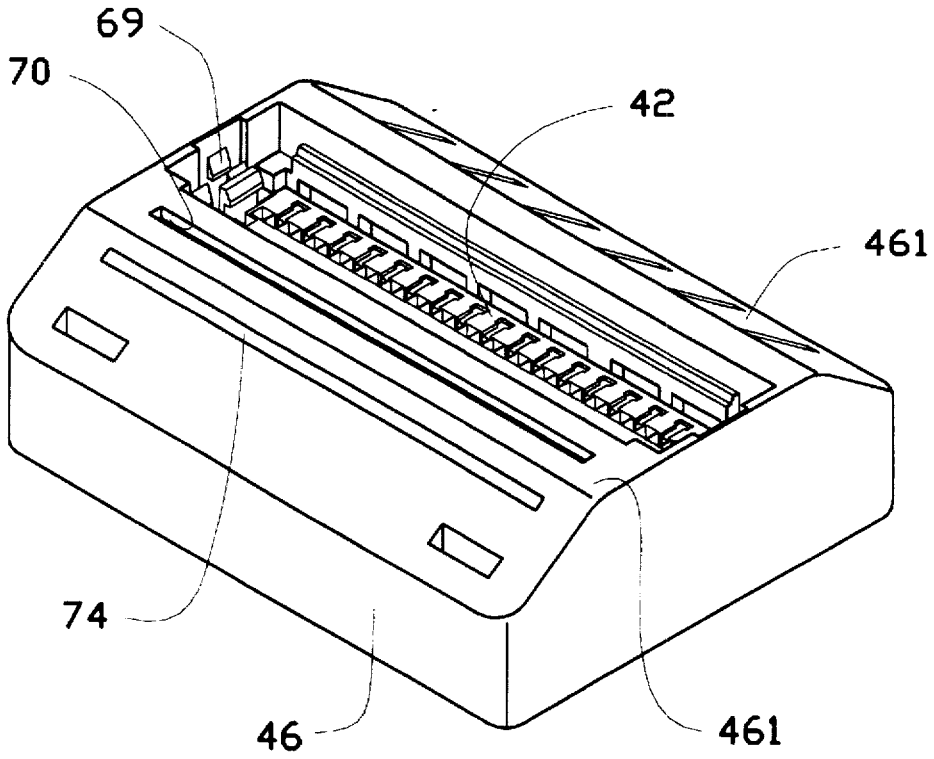
FIG. 7 is a perspective view of the upside-down housing of the terminator of the FIG. 6 to show the underside structure thereof.
Figure 8:
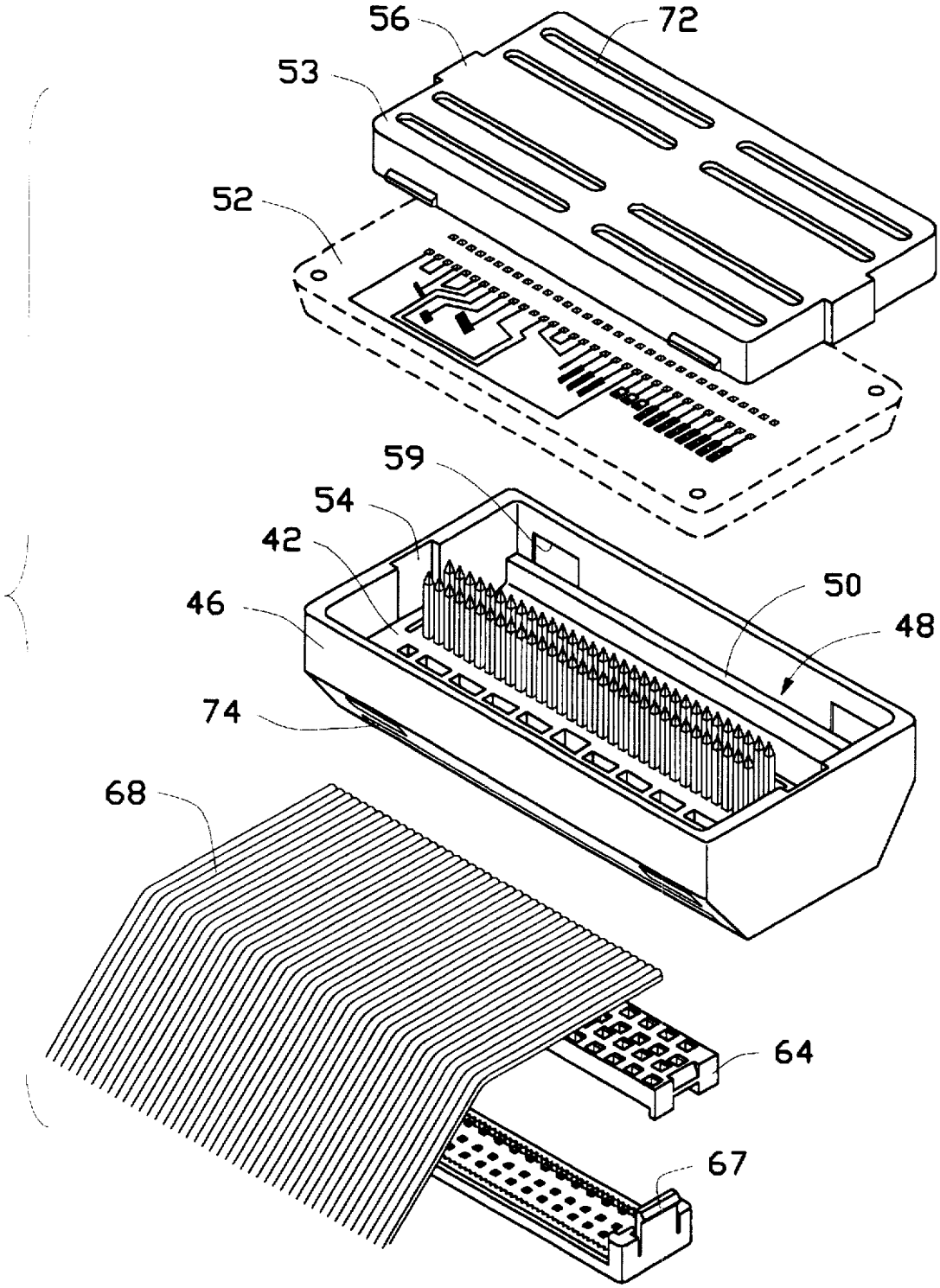
FIG. 8 is an exploded perspective view of the terminator of FIG. 6 with a flat cable adapted to be sandwiched therein.

FIGS. 6–8 show another embodiment of the invention wherein the housing 42 includes all the similar structures of the housing 12 of the first embodiment, and the terminator 40 further includes an additional expanded section 44 comprising four vertically extending raised walls 46 of which two are connected respectively with two lateral sides of the housing 12 by means of a pair of lateral expansion portion 461. Therefore, a substantially cavity 48 is defined by the surrounding walls 46.

The expanded section 44 includes a pair of supporting surfaces 50 which generally are coplanar with the top surface 41 of the housing 42 for having the PC board 52 seated thereon. To shield such PC board 52 (FIG. 8), a top cover 53 is assembled to the top of the housing 42 wherein a pair of channels 54 are formed in the lengthwise side walls 46 for engagement with the protrusions 56 formed on the cover top 53, and four engaging bars 58 are formed on the top cover 53 for latchable engagement within the corresponding openings 59 in the lateral side walls 46 of the terminator 40. Thus, the PC board 52 can be efficiently protected within the cavity 48 of the terminator 40 by such cover 53.

It can be understood that the contacts 62 and the spacer 64 are adapted to be assembled to the housing 42, and the contacts 62 securely extend through the PC board 52 by wave soldering, similar to those in the first embodiment. FIGS. 6 and 8 further disclose a bottom cover 66 which is adapted to be attached to the bottom side of the housing 42 with a flat cable 68 sandwiched therebetween wherein the bottom cover 66 includes the hooks 67 for latchable engagement with the corresponding embossments 69 (FIG. 7) on the housing 42. It is seen that different from the first embodiment having a simple type housing 12 which allows the flat cable 68 to be directly attached thereto from the bottom, the housing 42 of this embodiment with the expanded section 44 defines at least an insertion slots 74 on one lateral side for allowing the flat cable 68 to extend therethrough for lateral access to the bottom of the housing 42 for engagement with the contacts which extend downward from the bottom of the housing 42 and the bottom cover 66 which is adapted to be fastened to the housing 42 from the bottom.

As noted, to facilitate heat dissipation of the internal PC board 52, the expanded section 44 further includes plural first vents 70 (FIG. 7) therein and the top cover 53 also includes plural second vents 72 such that an additional heat convection performance can be achieved in comparison with the conventional heat conduction disclosed in the first embodiment. The huge space defined by the expanded section 44 also provides better heat dissipation effect than the first embodiment or other prior art terminators.

While the present invention has been described with reference to specific embodiments, the description is illustrative of the invent and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

We claim:

1. A terminator comprising:

an insulative housing including a plurality of passageways for receiving a number of corresponding contacts therein and a cavity for receiving a spacer therein;

each of said contacts including at least a pin upward extending from a top surface of the housing and a fork extending out of the housing;

said spacer including a plurality of passages for respectively aligning the forks of said contacts;

a PC board, which has a substantially larger lateral dimension than the housing for more passive and active electrical connectors mounted thereon and for better heat dissipation, being attached to the top surface of the housing by means that the pin of each contact solderably extends therethrough; and layer means protectively covering said PC board wherein said layer means includes an inner layer having characters of heat-proof and viscosity applied unto the whole PC board, and an outer layer having characters of impact and chemical resistance surrounding the inner layer.

2. The terminator as described in claim 1, wherein said inner layer includes recesses and ribs for incorporation with the outer layer for enhancing securement between the inner layer and the outer layer.

3. The terminator as described in claim 1, wherein each of said contacts further includes a horizontal retention section whereby the pin and the fork can respectively extend in opposite directions from two opposite ends thereof.

* * * * *